US007401448B2

(12) United States Patent
Sytema et al.

(10) Patent No.: US 7,401,448 B2
(45) Date of Patent: Jul. 22, 2008

(54) APPARATUS FOR INSERTING DOCUMENTS INTO ENVELOPES

(75) Inventors: Herman Sytema, Terhorne (NL); Fransiscus Hermannus Feijen, Leeuwarden (NL)

(73) Assignee: Neopost Technologies, French Limited Company, Bagneux (FR)

( * ) Notice: Subject to any disclaimer, the term of this patent is extended or adjusted under 35 U.S.C. 154(b) by 46 days.

(21) Appl. No.: 11/322,147

(22) Filed: Dec. 29, 2005

(65) Prior Publication Data

US 2006/0144016 A1 Jul. 6, 2006

(30) Foreign Application Priority Data

Dec. 31, 2004 (NL) ..... 1027933

(51) Int. Cl.
*B65B 43/26* (2006.01)

(52) U.S. Cl. ..... 53/381.7; 53/284.3; 53/381.5; 53/569

(58) Field of Classification Search ..... 53/381.7, 53/569, 117, 206, 381.3, 381.5, 284.3; 270/58.06
See application file for complete search history.

(56) References Cited

U.S. PATENT DOCUMENTS

| | | | | |
|---|---|---|---|---|
| 4,888,938 | A | 12/1989 | Auerbach | 53/569 |
| 4,924,652 | A | 5/1990 | Krasuski et al. | 53/55 |
| 4,926,612 | A | 5/1990 | Krasuski et al. | 53/69 |
| 4,955,186 | A | 9/1990 | Gough | 53/569 |
| 5,125,214 | A * | 6/1992 | Orsinger et al. | 53/460 |
| 5,255,498 | A * | 10/1993 | Hotchkiss et al. | 53/569 |
| 5,447,015 | A * | 9/1995 | Belec et al. | 53/492 |
| 5,675,959 | A * | 10/1997 | Hamma et al. | 53/381.1 |
| 7,155,878 | B2 * | 1/2007 | Stemmle et al. | 53/381.5 |

FOREIGN PATENT DOCUMENTS

| | | |
|---|---|---|
| CH | 453 950 | 6/1968 |
| DE | 28 38 436 A1 | 3/1980 |
| GB | 1084262 | 9/1967 |

* cited by examiner

*Primary Examiner*—Thanh K. Truong
(74) *Attorney, Agent, or Firm*—Sughrue Mion, PLLC

(57) ABSTRACT

An apparatus for inserting documents (2) having at least one guide strip (13, 14) which is reciprocable between a retracted position and a projecting position in which it reaches further into the stuffing position than in the retracted position for guiding into an envelope (11) in the stuffing position at least one document (2) coming from the document transport path (1).

7 Claims, 4 Drawing Sheets

APPARATUS FOR INSERTING DOCUMENTS INTO ENVELOPES

CROSS-REFERENCE TO RELATED APPLICATIONS

This application claims priority from Dutch Patent Application No. NL 1027933, filed on Dec. 31, 2004.

FIELD AND BACKGROUND OF THE INVENTION

This invention relates to an apparatus for inserting documents into envelopes. Such an apparatus is for instance known from U.S. Pat. No. 4,888,938 and are typically used in mailrooms where large numbers of documents or sets of documents are each to be inserted in an envelope in order to send these documents to addressees.

However, also in small organizations that send relatively small numbers of documents, and where the documents to be sent are for a considerable part processed by hand also when being prepared prior to insertion, mechanized insertion could lead to considerable saving of labor. To be considered here are, for instance, medical practices, workshops and club administrations, as well as service companies taking care of sending smaller mailings for third parties. Accordingly, there is a need for inserter machines that are compact enough and simple enough to be attractive in cost price and complexity of operation for applications on a smaller scale than existing inserter machines.

SUMMARY OF THE INVENTION

It is an object of the invention to provide a solution enabling a simpler and more compact structure of an inserter machine, in particular with respect to the structure for opening the envelope to be filled and for guiding documents into the envelope.

This object is achieved according to the invention by providing an apparatus for inserting documents, comprising:

a document transport path for transporting documents;

an envelope transport path for transporting envelopes;

a holder aligned with the envelope transport path for each time receiving and holding an envelope in a stuffing position aligned with the envelope transport path; and aligned with the document transport path for receiving in an envelope in the stuffing position at least one document coming from the document transport path;

a flap hold-open element for holding open a flap of an envelope in the stuffing position; and at plurality of guide strips reciprocable between a retracted position and a projecting position in which it reaches further into the stuffing position than in the retracted position, for guiding into an envelope in the stuffing position at least one document coming from the document transport path;

wherein, in the projecting position, laterally inner ones of the guide strips project further into the stuffing position than outer ones of the guide strips and, in retracted position, seen in a view along a plane parallel to the envelope stuffing position, outer ones of the guide strips project from a side of the inner ones of the guide strips remote from the flap hold-open element to the opposite side of the inner ones of the guide strips.

Thus, a reliable opening of the envelope and guidance of the document into the envelope can be realized in a particularly simple manner.

Embodiments of the invention are laid down in the dependent claims. Further features, effects and details of the invention are illustrated and elucidated on the basis of an exemplary embodiment with reference to the drawing.

DETAILED DESCRIPTION

Figure 1:
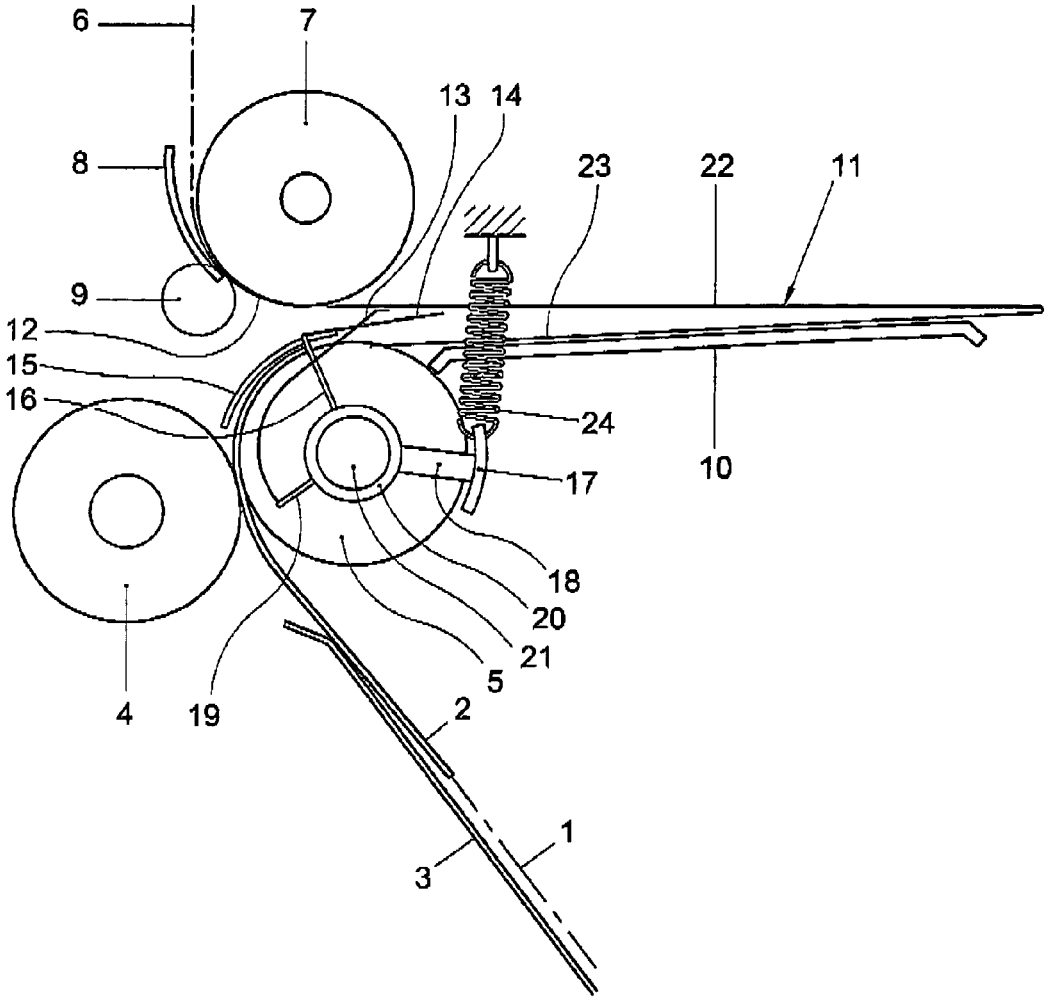
FIG. 1 is a schematic side elevation of an example of an apparatus according to the invention.

The apparatus according to the example represented in the drawing has a document transport path 1 for transporting documents, of which in this example a specimen 2 is represented in different stages of transport. The document transport path 1 according to this example is determined by a guide 3, a pair of opposite transport rollers 4, 5 and a guide 15.

For supplying envelopes there is provided an envelope transport path 6. The envelope transport path 6 passes, according to this example, between on the one hand a set of transport rollers 7 and on the other a guide 8 and a set of flap hold-open rollers 9.

Connected to the envelope transport path 6 is a holder 10 for receiving and holding an envelope 11 in a stuffing position aligned with the envelope transport path 6. The envelope 11 is represented in the drawing in the stuffing position, and, for the purpose of illustration, cutaway on the viewing side. It is noted that within the framework of the present invention, it is also possible to provide that the envelope can reach the stuffing position exclusively or additionally by a route other than along a path 6 with the flap trailing, for instance in opposite direction, with the flap leading. The flap hold-open element 9 keeps the flap 12 of the envelope 11 in the stuffing position open.

The holder 10 also aligns with the document transport path 1 for receiving in an envelope 11 in the stuffing position a document 2 or documents coming from the document transport path 1.

Guide strips 13, 14 are reciprocable between a retracted position (see FIGS. 1, 2 and 4) and a projecting position (see FIG. 3) in which they reach further into the stuffing position than in the retracted position, for guiding a document 2 coming from the document transport path 1 into the envelope 11 in the stuffing position.

Adjacent the guide 15, carriers 16 reach, via slots between the transport rollers 5, into the document transport path 1 for engagement by documents 2 transported along the document transport path 1. The carriers 16 can be carried along by documents 2 transported along the document transport path 1, from a rest position (FIGS. 1, 2, 4) to a carried position (FIG. 3).

The guide strips 13, 14 are coupled with the carriers 16 for displacement from the retracted position to the projecting position in response to the carriers 16 being carried along by a document 2 engaging the carriers 16. According to this example, this has been realized, as regards the central guide strips 14, in that the carriers 16 also form carrier arms via which the guide strips 14 are suspended pivotably about the centerline of the rollers 5. Further, the carriers 16 are coupled with the outer guide strips via a cross bar 17, supporting arms 18, 19 and a bearing 20 about the shaft 21 of the rollers 5. The carriers 16 are thus designed as rockers which are pivotable about the shaft 21 of the transport roller 5 of the transport path 1.

The guide strips 13, 14 serve for moving the neckline 23 of the envelope away from the other wall 22 of the envelope 11, and keeping it so, and for guiding documents 2, to prevent hooking, past the neckline 23 of the envelope 11.

Figure 3:
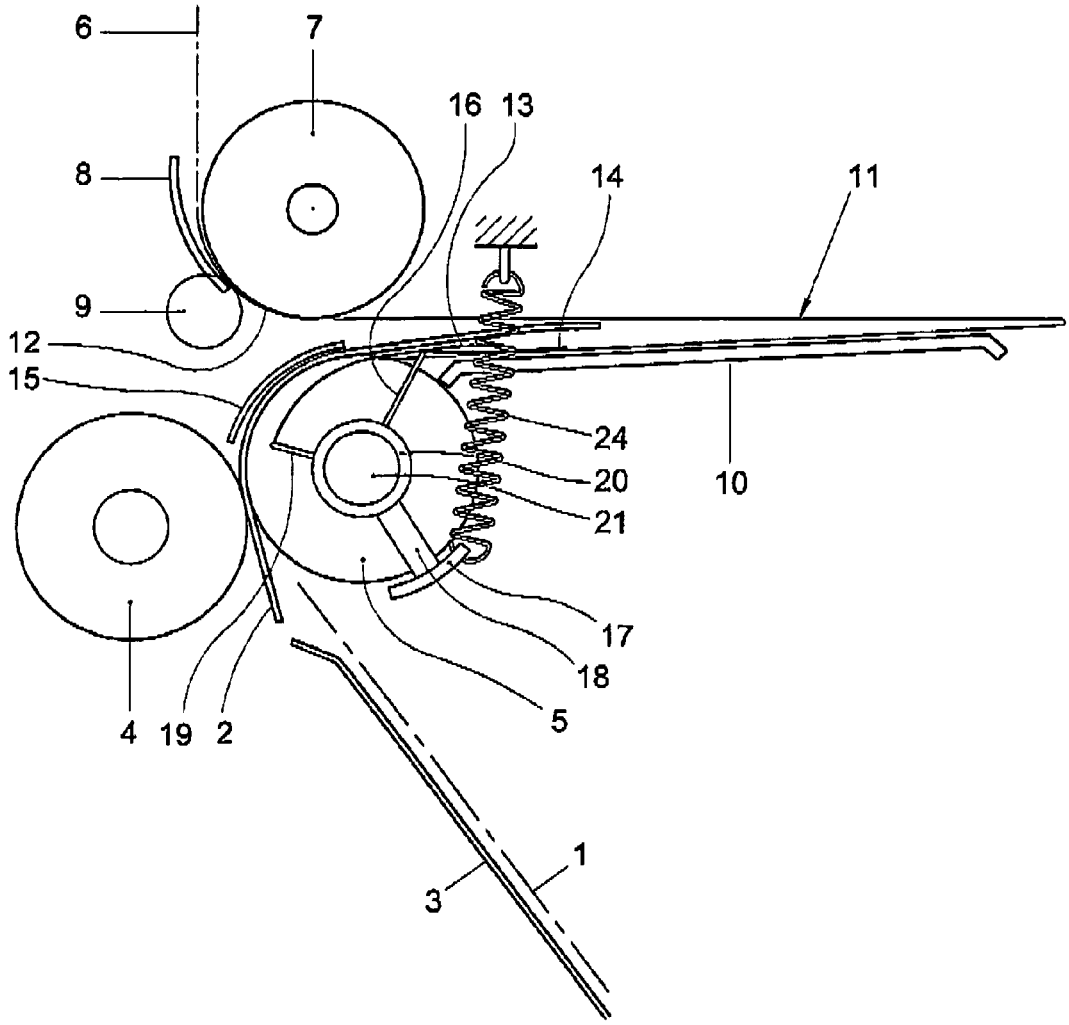
FIGS. 3 and 4 are similar views of the apparatus to FIG. 1, but in operative stages following the stage represented in FIGS. 1 and 2.

In the projecting position shown in FIG. 3, the (laterally) inner ones of the guide strips 14 project further into the stuffing position than outer ones of the guide strips 13 and, in retracted position, seen in a view along a plane parallel to the envelope stuffing position, outer ones of the guide strips 13 project from a side of the inner ones of the guide strips 14 remote from the flap hold-open rollers 9 to the opposite side of the inner ones of the guide strips 14. Thus, in the projecting position, the inner ones of the guide strips 14 project deep into the envelope 11 parallel or almost parallel to the envelope stuffing position, so that the envelope neckline is reliably opened to its deepest point, while the risk of damage to the envelope 11 is small and the outer ones of the guide strips 13 open the envelope relative far closely along its edges, so that entering document are reliably prevented from clinging to the envelope neckline close to the outer edges of the envelope.

The guide strips 13, 14 are suspended to a carrier 16 rotatable about an axis parallel to the envelope stuffing position, wherein the outer ones of the guide strips 13 extend from positions at the carrier 16 that are located closer to the axis of rotation of the carrier 16 than the positions from which the inner ones of the guide strips 14 project. In this manner the difference in angels at which the guide strips 13, 14 project into the envelope 11, when in the projecting position is realized in a simple manner.

Figure 2:
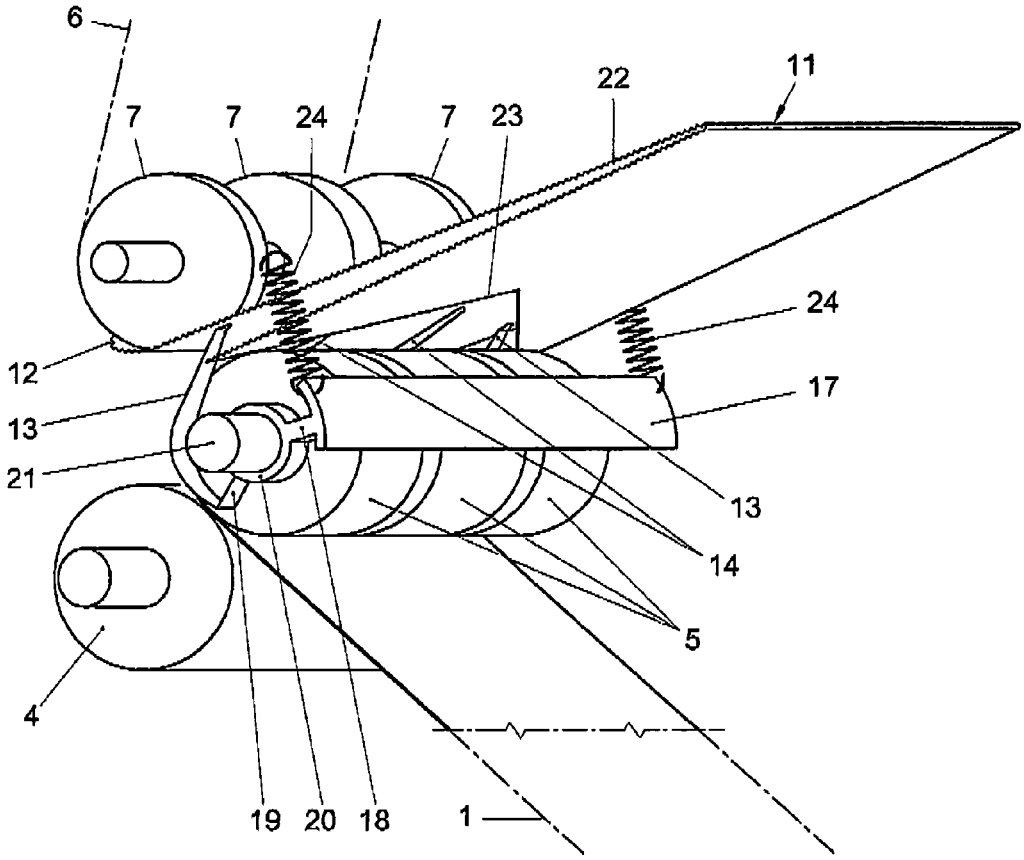
FIG. 2 is a cutaway, schematic perspective representation of the apparatus according to FIG. 1.

In operation, the carriers 16 are carried along from the moment when a document 2 advancing along the document transport path 1 reaches the position represented in FIGS. 1 and 2. As the leading edge of the document 2 is held against or at least close to the rollers 5 by the guide 15, the carriers 16 are reliably pushed on by the advancing document. However, as soon as the leading edge of the document 2 reaches the downstream end of the guide 15, it gets an opportunity to leave the path of the carriers 16, thereby coming off the carriers. The place where the advancement of the carriers 16 by the leading edge 2 of a document 2 terminates is reliably determined by the place in the paths of travel of the carriers 16 where the downstream end of the guide is situated. However, the termination of the carriers being carried along can also be determined in a different manner, for instance in that the carriers are so suspended that, upon being carried along, they leave the transport path at a particular point.

Owing to the carriers 16 being carried along by a document 2 engaging the carriers, the operation of the movement of the guide strips 13, 14 from the retracted position to the projecting position can be realized in a particularly simple manner. This does not require any sensors or separate drives.

Owing to the carriers 16 reaching into the document transport path 1 for being carried along by a document 2 following the document transport path 1, it can be realized in a simple manner that the guide strips 13, 14, just before the document 2 reaches the envelope 11, bring the envelope 11 into the open position required for the insertion of the document 2. It is also possible, however, to arrange for the envelope to be timely held open in a different manner, for instance in that the carriers are carried along by the envelope, and the guide strips are coupled with the carriers via a transmission, so that they keep the envelope open as soon as it arrives in the stuffing position.

Owing to the guide strips 13, 14 being coupled with the carriers 16 for displacement from the retracted position to the projecting position, driven by displacement of the carriers 16, the transmission of the movement of the carriers 16 to the movement of the guide strips 13, 14 is particularly simple. In this regard, too, however, other solutions are conceivable, for instance, a carrier can operate a clutch which ensures that the strips are driven to the projecting position through rotation of a transport roller.

Figure 4:
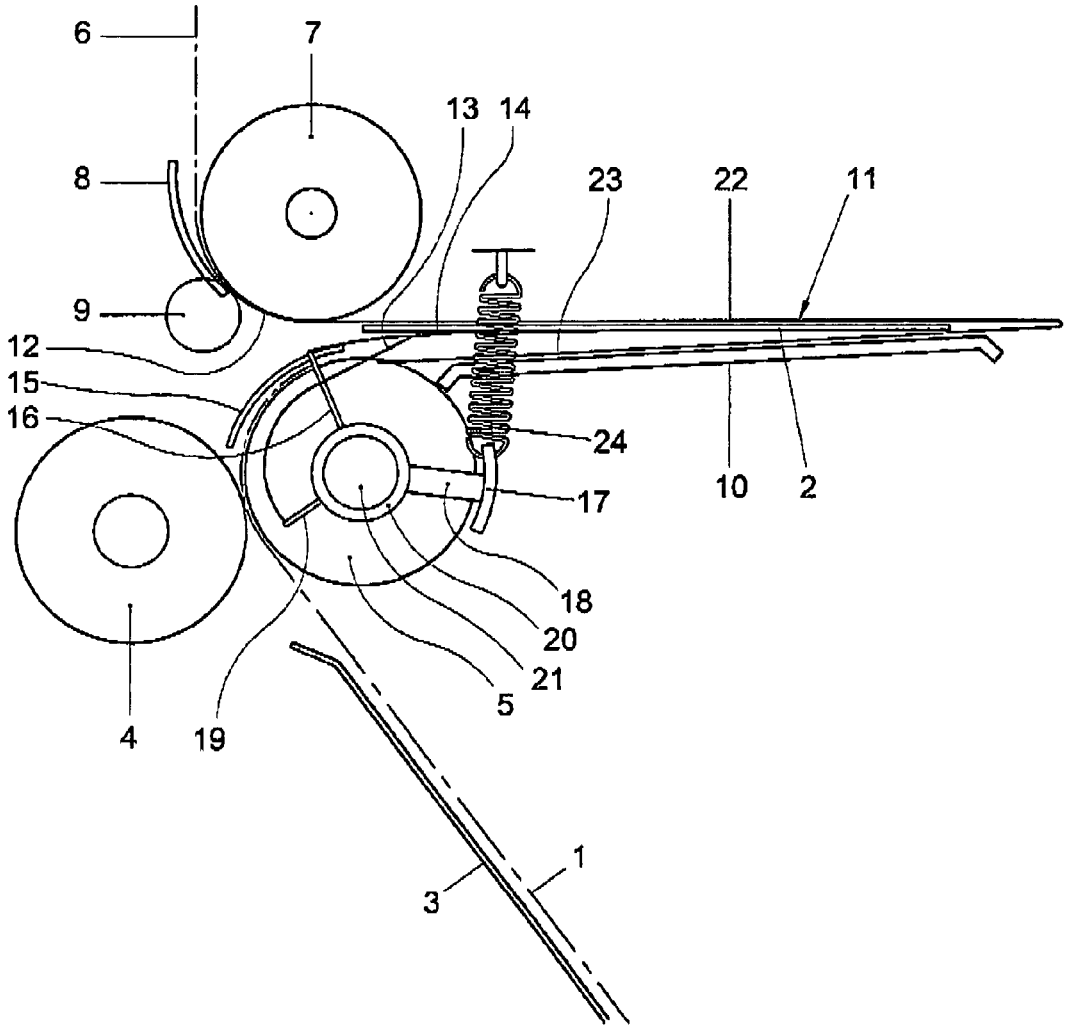

From the position represented in FIG. 4, the envelope 11 can be discharged in a direction away from the transport rollers 5, 7. If it is desired to discharge the envelope 11 between the transport rollers 5, 7, it may for instance be provided that through rotation of the transport roller 5 against the input sense, the supporting arms 16, 18, 19 are carried along, so that the strips swing out of the discharge path of the envelope 11. According to this example, the retraction of the strips to the retracted position is driven by springs 24 engaging the cross bar 17.

The invention claimed is:

1. An apparatus for inserting documents, comprising:

a document transport path for transporting documents towards a stuffing position;

an envelope transport path for transporting envelopes towards the stuffing position;

a holder aligned in a first direction with the envelope transport path for receiving and holding an envelope in the stuffing position aligned with the envelope transport path; and aligned in the first direction with the document transport path for receiving, in the envelope in the stuffing position, at least one document arriving from the document transport path, wherein edges of the envelope in the stuffing position extend along a stuffing position plane;

a flap hold-open element for holding open a flap of an envelope in the stuffing position; and a plurality of guide strips simultaneously reciprocable between a retracted position and a projecting position for guiding at least one document from the document transport path into an envelope in the stuffing position, wherein the guide strips in the projecting position project into the stuffing position in said first direction and the guide strips in the retracted position are retracted relative to said projecting position in a second direction opposite said first direction;

wherein the guide strips include at least one inner guide strip and outer guide strips located on opposite lateral sides of the at least one inner strip, wherein, in the projecting position, the at least one inner guide strips project further into the stuffing position than the outer guide strips, and, wherein in the retracted position, seen in a view transverse to said first direction and parallel to the envelope stuffing plane, the outer guide strips project from a neck side of the envelope remote from the flap hold-open element toward a flap side of the envelope opposite the neck side.

2. An apparatus according to claim 1, further comprising at least one carrier rotatable about an axis of rotation parallel to the envelope stuffing plane, wherein the at least one inner guide strip projects from an inner position at the at least one carrier and wherein the outer guide strips project from outer positions at the at least one carrier, which are located closer to the axis of rotation than the at least one inner positions from which the at least one inner guide strips projects.

3. An apparatus according to claim 2, wherein, when the guide strips are in the retracted position, a portion of the at least one carrier extends into the document transport path for engagement by a document transported along the document transport path towards the stuffing position, the document transported along the document transport path pushing the carrier in rotation about the axis of rotation from a first position with the guide strips in the retracted position to a second position with the guide strips in the projected position;

wherein the at least one inner position at the at least one carrier from which the at least one inner guide strips extends rotatable along a trajectory more remote from the axis of rotation of the at least one carrier than adjacent sections of the document transport path.

4. An apparatus according to claim 2, wherein the at least one carrier is pivotable about a shaft of a transport roller of the document transport path.

5. An apparatus according to claim 4, further comprising a guide which extends at least along a circumferential portion of the transport roller of the document transport path, for cooperation with the transport roller to urge the document into engagement with the at least one carrier.

6. An apparatus according to claim 2, further comprising a spring for biasing the at least one carrier towards a position in which the guide strips are in the retracted position.

7. An apparatus according to claim 2, wherein, if the guide strips are in the retracted position, a portion of the at least one carrier is engageable by an envelope transported along the envelope transport path towards the stuffing position, the envelope transported along the envelope transport path causing the at least one carrier to move from a first position with the guide strips in the retracted position to a second position with the guide strips in the projected position.

* * * * *